US012089637B2

(12) United States Patent
Saygili

(10) Patent No.: US 12,089,637 B2
(45) Date of Patent: Sep. 17, 2024

(54) AEROSOL GENERATING SYSTEM AND CARTRIDGE WITH LEAKAGE PROTECTION

(71) Applicant: Philip Morris Products S.A., Neuchatel (CH)

(72) Inventor: Ali Murat Saygili, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 262 days.

(21) Appl. No.: 17/311,016

(22) PCT Filed: Dec. 6, 2019

(86) PCT No.: PCT/EP2019/084094
§ 371 (c)(1),
(2) Date: Jun. 4, 2021

(87) PCT Pub. No.: WO2020/115321
PCT Pub. Date: Jun. 11, 2020

(65) Prior Publication Data

US 2022/0022536 A1 Jan. 27, 2022

(30) Foreign Application Priority Data

Dec. 7, 2018 (EP) ..... 18211155

(51) Int. Cl.
*A24F 40/42* (2020.01)
*A24F 40/10* (2020.01)
(Continued)

(52) U.S. Cl.
CPC ..... *A24F 40/42* (2020.01); *A24F 40/10* (2020.01); *A24F 40/46* (2020.01); *A24F 40/48* (2020.01)

(58) Field of Classification Search
CPC ..... A24F 40/42; A24F 40/48; A24F 40/10; A24F 40/46
See application file for complete search history.

(56) References Cited

U.S. PATENT DOCUMENTS 10,881,146 B2 * 1/2021 Qiu ..... A24F 13/00
2012/0248359 A1 * 10/2012 Dederich ..... F16K 31/54 251/248

(Continued)

FOREIGN PATENT DOCUMENTS

CN 108685183 A 10/2018
EP 3 387 925 A1 10/2018

(Continued)

OTHER PUBLICATIONS

International Search Report and Written Opinion issued on Mar. 25, 2020 in PCT/EP2019/084094 filed on Dec. 6, 2019.

(Continued)

*Primary Examiner* — Christopher M Rodd
*Assistant Examiner* — Daniel Edward Vakili
(74) *Attorney, Agent, or Firm* — Oblon, McClelland, Maier & Neustadt, L.L.P.

(57) ABSTRACT

An aerosol-generating system is provided, including: a reservoir holding an aerosol-generating substrate in condensed form; a housing including an air inlet, an air outlet, an airflow passage extending therebetween, and a chamber; a liquid-permeable heating element extending parallel to the passage, one side of the heating element in fluidic communication with the reservoir and an opposite side in fluidic communication with the chamber, the heating element to heat the substrate in condensed form to generate a vapour within the chamber; and a gas-permeable element extending generally parallel to the passage, one side of the gas-permeable element in fluidic communication with the chamber and an opposite side element in fluidic communication (Continued)

with the airflow passage, the gas-permeable element to allow transport of the vapour into the passage and to inhibit transport of the condensed form into the passage, and the vapour at least partially condensing into an aerosol within the passage.

15 Claims, 8 Drawing Sheets

(51) Int. Cl.
*A24F 40/46* (2020.01)
*A24F 40/48* (2020.01)

(56) References Cited

U.S. PATENT DOCUMENTS

| | | | | |
|---|---|---|---|---|
| 2014/0060554 | A1 | 3/2014 | Collett et al. | |
| 2015/0027459 | A1 | 1/2015 | Collett et al. | |
| 2015/0289567 | A1 | 10/2015 | Liu | |
| 2017/0027226 | A1 | 2/2017 | Mironov et al. | |
| 2017/0035113 | A1 | 2/2017 | Thorens | |
| 2017/0164657 | A1 | 6/2017 | Batista | |
| 2017/0196268 | A1 | 7/2017 | Reevell | |
| 2017/0354184 | A1 | 12/2017 | Mironov et al. | |
| 2018/0263290 | A1 | 9/2018 | Collett et al. | |
| 2018/0289061 | A1 | 10/2018 | Mo et al. | |
| 2019/0092559 | A1* | 3/2019 | Faircloth | B65D 85/10 |
| 2019/0174827 | A1* | 6/2019 | Fernando | A24F 47/00 |
| 2019/0216129 | A1* | 7/2019 | Jain | A24F 15/18 |
| 2019/0274359 | A1* | 9/2019 | Jain | A24F 47/00 |
| 2020/0047954 | A1* | 2/2020 | Giovannetti | B65D 39/08 |
| 2021/0045450 | A1* | 2/2021 | Lomas | A24F 40/485 |

FOREIGN PATENT DOCUMENTS

| | | | | | |
|---|---|---|---|---|---|
| GB | 2561958 | A | | 10/2018 | |
| JP | 2017-506076 | A | | 3/2017 | |
| JP | 2018-500015 | A | | 1/2018 | |
| JP | 2018-509158 | A | | 4/2018 | |
| KZ | 31601 | B | | 9/2016 | |
| RU | 2 604 313 | C2 | | 12/2016 | |
| RU | 2 643 422 | C2 | | 2/2018 | |
| RU | 2 655 192 | C1 | | 5/2018 | |
| RU | 2 667 228 | C1 | | 9/2018 | |
| WO | WO2015/117702 | A1 | * | 8/2015 | A24F 47/00 |
| WO | WO 2016/005533 | A1 | | 1/2016 | |
| WO | WO 2016/096733 | A1 | | 6/2016 | |
| WO | WO 2016/096745 | A1 | | 6/2016 | |
| WO | WO2016/145072 | A1 | * | 9/2016 | A24F 47/00 |
| WO | WO 2018/019485 | A1 | | 2/2018 | |
| WO | WO 2018/055334 | A1 | * | 3/2018 | A24F 47/00 |

OTHER PUBLICATIONS

Extended European Search Report issued Jul. 11, 2019 in European Patent Application No. 18211155.9, 8 pages.
International Preliminary Report on Patentability and Written Opinion of the International Searching Authority issued Jun. 17, 2021 in PCT/EP2019/084094, 7 pages.
Combined Russian Office Action and Search Report issued Mar. 20, 2023 in Russian Patent Application No. 2021117888/03 (with English Translation), 12 pages.
Combined Chinese Office Action and Search Report issued Sep. 6, 2023 in Chinese Patent Application No. 201980075068.7 (with English Translation), 12 pages.
Japanese Office Action mailed on Nov. 20, 2023 issued in Japanese Patent Application No. 2021-528955 filed on Dec. 6, 2019, with English Translation, total 10 pages.

* cited by examiner

AEROSOL GENERATING SYSTEM AND CARTRIDGE WITH LEAKAGE PROTECTION

The invention relates to aerosol-generating systems and in particular aerosol-generating systems that produce an aerosol for inhalation by a user.

One type of aerosol-generating system is an electrically heated smoking system that generates an aerosol for a user to inhale. Electrically heated smoking systems come in various forms. One popular type of electrically heated smoking system is an e-cigarette that vapourises a liquid aerosol-forming substrate, or other condensed form of aerosol-forming substrate, to generate an aerosol.

WO2015/117702A describes an aerosol-generating system that heats a liquid substrate to form an aerosol. The heating is accomplished using a mesh of heating filaments. The liquid is conveyed to the mesh from a liquid reservoir by a capillary material on one side of the mesh. An airflow channel is on the other side of the mesh. Vaporised liquid aerosol-forming substrate passes through the mesh into the airflow channel. The mesh, together with the capillary material, is used to prevent the passage of liquid droplets into the airflow channel.

However, in some circumstances the liquid substrate may condense or leak, and as a result may be sucked through the airflow channel. This may result in a diminished experience for the user.

In a first aspect herein, there is provided an aerosol-generating system, comprising:

a reservoir holding an aerosol-generating substrate in condensed form;

a housing comprising an air inlet, an air outlet, an airflow passage extending therebetween, and a chamber;

a liquid-permeable heating element extending generally parallel to the airflow passage, one side of the heating element being in fluidic communication with the reservoir and an opposite side of the heating element being in fluidic communication with the chamber, the heating element configured to heat the aerosol-generating substrate in condensed form to generate a vapour within the chamber; and a gas-permeable element extending generally parallel to the airflow passage, one side of the gas-permeable element being in fluidic communication with the chamber and an opposite side of the gas-permeable element being in fluidic communication with the airflow passage.

Advantageously, the gas-permeable element may be configured to allow transport of the vapour into the airflow passage and may be configured to inhibit transport of the condensed form of the aerosol-generating substrate into the airflow passage. The vapour may at least partially condense into an aerosol within the airflow passage. The gas-permeable element may be configured to transport substantially all of the vapour generated within the chamber into the airflow passage. Advantageously, substantially all of the vapour generated within the chamber condenses into an aerosol within the airflow passage.

The gas-permeable element may comprise a mesh. Optionally, the mesh may be hydrophobic. Additionally, or alternatively, the mesh optionally may be formed from wire having a diameter between about 10 μm and 100 μm.

Additionally, or alternatively, in some configurations, the aerosol-generating substrate optionally, comprises nicotine.

Additionally, or alternatively, in some configurations, the housing comprises a mouthpiece in which the reservoir is disposed.

Additionally, or alternatively, in some configurations, the housing comprises an atomizer assembly holding the liquid-permeable heating element and the gas-permeable element in spaced relation to one another. Optionally, the atomizer assembly further may comprise a lid extending generally parallel to the airflow passage. The gas-permeable element optionally may be disposed between the lid and the heating element. Optionally, the lid comprises a protruding portion configured to block the airflow passage responsive to rotation of the lid. Additionally, or alternatively, the lid optionally further may comprise a slot configured to receive a key. The lid optionally may be rotatable responsive to engagement of the key into the slot followed by rotation of the key.

Additionally, or alternatively, in some configurations, a first portion of the airflow passage optionally is defined in the mouthpiece and a second portion of the airflow passage is defined in the atomizer assembly.

Additionally, or alternatively, in some configurations, the airflow passage optionally extends in a straight line between the air inlet and the air outlet. This allows for a simple construction and assembly and may reduce the likelihood of condensates collecting at particular locations within the airflow path.

Additionally, or alternatively, in some configurations, the heating element optionally is a mesh heating element.

Additionally, or alternatively, in some configurations the aerosol-generating system further comprises an optional device portion comprising a power supply and control circuitry connected to the power supply. The device portion optionally may be coupled to the housing to allow for a supply of power from the power supply to the heating element.

Under another aspect herein, a method for generating an aerosol is provided. The method may comprise:

holding, by a reservoir, an aerosol-generating substrate in condensed form;

heating, by a liquid-permeable heating element, the aerosol-generating substrate to generate a vapour within a chamber;

allowing transport, by a gas-permeable element, of the vapour into an airflow passage;

inhibiting transport, by the gas-permeable element, of the condensed form of the aerosol-generating substrate into the airflow passage; and at least partially condensing the vapour into an aerosol within the airflow passage.

Advantageously, the heating element may extend generally parallel to an airflow passage within a housing. The housing further may comprise an air inlet and an air outlet, the airflow passage extending therebetween, and a chamber. One side of the heating element may be in fluidic communication with the reservoir and an opposite side of the heating element may be in fluidic communication with the chamber. The gas-permeable element may extend generally parallel to the airflow passage, one side of the gas-permeable element being in fluidic communication with the chamber and an opposite side of the gas-permeable element being in fluidic communication with the airflow passage. The method suitably may be implemented using the systems provided herein, but is not limited thereto.

The present systems and methods may include any suitable combination of optional features and configurations. For example, where the gas-permeable element comprises a mesh, the mesh may advantageously be formed from a corrosion resistant material, such as stainless steel. The mesh may be coated with a material that increases the hydrophobicity or oleophobicity of the mesh. For example, nano-coatings of silicon carbide, silicon oxide, fluoropolymers, titanium oxide or aluminium oxide may be applied to the mesh, or to filaments prior to formation of a mesh from the filaments, by liquid phase deposition, vapour phase deposition or thermal plasma evaporation.

Where the gas-permeable element comprises a mesh formed from a plurality of filaments, the filaments may be arranged in a square weave so that the angle between filaments that contact one another is approximately 90°. However, other angles between filaments that contact one another may be used. Preferably the angle between filaments that contact one another is between 30° and 90°. The plurality of filaments may comprise a woven or non-woven fabric.

The aerosol-generating system may comprise a reservoir (substrate chamber) for holding the aerosol-forming substrate. The aerosol-forming substrate may be a liquid at room temperature. In that case the reservoir may be described as a liquid reservoir. The aerosol-forming substrate may be in another condensed form, such as a solid at room temperature, or may be in another condensed form, such as a gel, at room temperature, or may be in another condensed form, such as a liquid, at room temperature. The aerosol generating element may be provided, at least in part, between the reservoir and the airflow passage.

The aerosol-generating element may comprise a heating element. Heating the aerosol-forming substrate may release volatile compounds from the aerosol-forming substrate as a vapour. The vapour may then cool within an airflow (such as within an airflow passage) to form an aerosol.

The heating element may be configured to operate by resistive heating. In other words, the heating element may be configured to generate heat when an electrical current is passed though the heating element.

The heating element may be configured to operate by inductive heating. In other words, the heating element may comprise a susceptor that, in operation, is heated by eddy currents induced in the susceptor. Hysteresis losses may also contribute to the inductive heating.

The heating element may be arranged to heat the aerosol-forming substrate by conduction. The heating element may be in fluidic communication, e.g., direct or indirect contact with the aerosol-forming substrate. For example, the heating element may be in fluidic communication, e.g., may be in direct or indirect contact, with the reservoir. The heating element may be arranged to heat the aerosol-forming substrate by convection. In particular, the heating element may be configured to heat a flow of air that subsequently passes through, or by, the aerosol-forming substrate.

The heating element may be liquid permeable (fluid permeable). In particular, the heating element may permit vapour from the aerosol-forming substrate to pass through the heating element and into the chamber. The heating element may be positioned between the chamber and the reservoir, or between the chamber and a channel coupled to the reservoir, or between the chamber and one or more transport media (such as a capillary material) coupled to the reservoir. The heating element may separate the chamber from the reservoir or may separate the chamber from said channel or may separate the chamber from said one or more transport media. One side of the heating element may be in fluidic communication, e.g., in direct or indirect contact, with chamber and an opposite side of the heating element may be in fluidic communication, e.g., in direct or indirect contact, with the aerosol generating substrate (aerosol forming substrate).

In some embodiments, the heating element is a generally planar, fluid permeable heating element, such as a mesh, perforated plate or perforated foil.

The heating element may comprise a mesh formed from a plurality of electrically conductive filaments. The electrically conductive filaments may define interstices between the filaments and the interstices may have a width of between 10 μm and 100 μm. Preferably the filaments give rise to capillary action in the interstices, so that in use, liquid aerosol-forming substrate to be vapourised is drawn into the interstices, increasing the contact area between the heater assembly and the liquid.

The electrically conductive filaments may form a mesh of size between 160 and 600 Mesh US (+1-10%) (i.e. between 160 and 600 filaments per inch (+1-10%)). The width of the interstices is preferably between 75 μm and 25 μm. The percentage of open area of the mesh, which is the ration of the area of the interstices to the total area of the mesh is preferably between 25 and 56%. The mesh may be formed using different types of weave or lattice structures. Alternatively, the electrically conductive filaments consist of an array of filaments arranged parallel to one another.

The electrically conductive filaments may have a diameter of between 8 μm and 100 μm, preferably between 8 μm and 50 μm, and more preferably between 8 μm and 39 μm.

The area of the mesh, array or fabric of electrically conductive filaments may be small, preferably less than or equal to 25 $mm^2$, allowing it to be incorporated in to a handheld system. The mesh, array or fabric of electrically conductive filaments may, for example, be rectangular and have dimensions of 5 mm by 2 mm.

The electrically conductive filaments may comprise any suitable electrically conductive material. Suitable materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, constantan, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminium based alloys and iron-manganese-aluminium based alloys. Timetal® is a registered trade mark of Titanium Metals Corporation. The filaments may be coated with one or more insulators. Preferred materials for the electrically conductive filaments are 304, 316, 304L, and 316L stainless steel, and graphite.

The electrical resistance of the mesh, array or fabric of electrically conductive filaments of the heater element is preferably between 0.3 and 4 Ohms. More preferably, the electrical resistance of the mesh, array or fabric of electrically conductive filaments is between 0.5 and 3 Ohms, and more preferably about 1 Ohm.

The system may comprise electrical contacts fixed to the heating element. Electrical current may be passed to and from the heating element through the electrical contacts, for example from a device portion to which the housing can be releasably coupled. The electrical resistance of the mesh, array or fabric of electrically conductive filaments is preferably at least an order of magnitude, and more preferably at least two orders of magnitude, greater than the electrical resistance of the electrical contacts. This ensures that heat is generated by the heating element and not by the electrical contacts.

The aerosol-generating element may atomise the aerosol-forming substrate by a method other than heating. For example, the aerosol-generating element may comprise a vibrating membrane or may force the aerosol-forming substrate through a fine mesh.

The reservoir (aerosol-forming substrate chamber) may comprise, or may be coupled to, a capillary material or other liquid retention material configured to ensure a supply of aerosol-forming substrate to the heating element or other aerosol-generating element.

The capillary material may have a fibrous or spongy structure. The capillary material preferably comprises a bundle of capillaries. For example, the capillary material may comprise a plurality of fibres or threads or other fine bore tubes. The fibres or threads may be generally aligned to convey liquid to the heater or other aerosol-generating element. Alternatively, the capillary material may comprise sponge-like or foam-like material. The structure of the capillary material forms a plurality of small bores or tubes, through which the liquid can be transported by capillary action. The capillary material may comprise any suitable material or combination of materials. Examples of suitable materials are a sponge or foam material, ceramic- or graphite-based materials in the form of fibres or sintered powders, foamed metal or plastics material, a fibrous material, for example made of spun or extruded fibres, such as cellulose acetate, polyester, or bonded polyolefin, polyethylene, terylene or polypropylene fibres, nylon fibres or ceramic.

The capillary material may be in fluidic communication, e.g., in direct or indirect contact, with the electrically conductive filaments of the heating element. The capillary material may extend into interstices between the filaments. The heating element may draw liquid aerosol-forming substrate into the interstices by capillary action.

The housing may contain two or more different capillary materials (two or more transport media), wherein a first capillary material, in contact with the heating element, has a higher thermal decomposition temperature and a second capillary material, in contact with the first capillary material but not in contact with the heating element has a lower thermal decomposition temperature. The first capillary material effectively acts as a spacer separating the heating element from the second capillary material, so that the second capillary material is not exposed to temperatures above its thermal decomposition temperature. As used herein, "thermal decomposition temperature" means the temperature at which a material begins to decompose and lose mass by generation of gaseous by products. The second capillary material may advantageously occupy a greater volume than the first capillary material and may hold more aerosol-forming substrate that the first capillary material. The second capillary material may have superior wicking performance to the first capillary material. The second capillary material may be a less expensive or have a higher filling capability than the first capillary material. The second capillary material may be polypropylene.

The aerosol-generating system may comprise an internal housing part defining the chamber. The internal housing part may be received in an external housing part. The external housing part may include a mouthpiece on which a user puffs to draw air through the airflow passage from the air inlet to the air outlet. The gas-permeable element may be positioned on the internal housing part. The gas-permeable element may be positioned between the chamber and the airflow channel. The gas-permeable element may separate the chamber from the airflow channel. One side of the gas-permeable element may be in fluidic communication, e.g., in direct or indirect contact, with chamber and an opposite side of the gas-permeable element may be in fluidic communication, e.g., in direct or indirect contact, with the airflow passage. The gas-permeable element may be fixed to the internal housing part by clamping. For example, the gas-permeable element may be clamped between two housing portions. The gas-permeable element may be fixed to the internal housing part by overmoulding. In other words a portion of the internal housing part may be moulded around the gas-permeable element.

The aerosol-generating system may comprise one or more air inlets, and optionally may comprise a plurality of air inlets. The aerosol-generating system may comprise an air outlet, and optionally may comprise a plurality of air outlets.

The aerosol-generating system may have an external housing part. The external housing part may be configured to be held by a user in a single hand. The external housing part may be formed from a plastics material or from a metal.

The aerosol-generating system may be refillable with aerosol forming substrate. The aerosol-forming substrate may be a liquid at room temperature. The aerosol-forming substrate may be a gel or may be solid at room temperature. The aerosol-forming substrate may be provided in the form or a capsule or tablet, or may be provided in a particulate form.

The aerosol-forming substrate is or includes a substrate capable of releasing volatile compounds that can form an aerosol. The volatile compounds may be released by heating the aerosol-forming substrate.

The aerosol-forming substrate may comprise plant-based material. The aerosol-forming substrate may comprise tobacco. The aerosol-forming substrate may comprise a tobacco-containing material containing volatile tobacco flavour compounds, which are released from the aerosol-forming substrate upon heating. The aerosol-forming substrate may alternatively comprise a non-tobacco-containing material. The aerosol-forming substrate may comprise homogenised plant-based material. The aerosol-forming substrate may comprise homogenised tobacco material. The aerosol-forming substrate may comprise at least one aerosol-former. An aerosol-former is any suitable known compound or mixture of compounds that, in use, facilitates formation of a dense and stable aerosol and that is substantially resistant to thermal degradation at the operating temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1,3-butanediol and, most preferred, glycerine. The aerosol-forming substrate may comprise other additives and ingredients, such as flavourants and water.

The system may further comprise electric circuitry connected to the heater element and to an electrical power source, the electric circuitry configured to monitor the electrical resistance of the heating element or of one or more filaments of the heating element, and to control the supply of power to the heating element from the power source dependent on the electrical resistance of the heating element or specifically the electrical resistance of the one or more filaments. Optionally, the electric circuitry and the electrical power source can be disposed within a device portion to which the housing can be releasably coupled.

The electric circuitry may comprise a microprocessor, which may be a programmable microprocessor, a microcontroller, or an application specific integrated chip (ASIC) or other electronic circuitry capable of providing control. The electric circuitry may comprise further electronic components. The electric circuitry may be configured to regulate a supply of power to the heating element or other aerosol-generating component. Power may be supplied to the heating element continuously following activation of the system or may be supplied intermittently, such as on a puff by puff basis. The power may be supplied to the heating element in the form of pulses of electrical current.

The system may be an electrically operated smoking system. The system may be a handheld aerosol-generating system. The aerosol-generating system may have a size comparable to a conventional cigar or cigarette. The smoking system may have a total length between approximately 30 mm and approximately 150 mm. The smoking system may have an external diameter between approximately 5 mm and approximately 30 mm.

The system advantageously comprises a power supply, typically a battery such as a lithium iron phosphate battery, within the main body of the housing or within a device portion that may be coupled to the main body of the housing. As an alternative, the power supply may be another form of charge storage device such as a capacitor. The power supply may require recharging and may have a capacity that allows for the storage of enough energy for one or more smoking experiences. For example, the power supply may have sufficient capacity to allow for the continuous generation of aerosol for a period of around six minutes, corresponding to the typical time taken to smoke a conventional cigarette, or for a period that is a multiple of six minutes. In another example, the power supply may have sufficient capacity to allow for a predetermined number of puffs or discrete activations of the heater.

The aerosol-generating system may comprise a cartridge and a device portion, the cartridge being coupled to the device portion in use. The cartridge may comprise the aerosol-forming substrate, the chamber and the heating element or other aerosol-generating element. The device portion may comprise a power supply and control circuitry connected to the power supply. The device portion is coupled to the cartridge to allow for a supply of power from the power supply to the aerosol-generating element.

The cartridge may comprise the air outlet. The cartridge may comprise the reservoir holding the aerosol-generating substrate in condensed form. The cartridge may comprise the housing. The cartridge may comprise the liquid-permeable heating element. The cartridge may comprise the gas-permeable element. The cartridge may comprise the chamber. The cartridge may comprise the internal housing part and the external housing part. The device portion may comprise a device housing that engages with the internal housing part or the external housing part, or both. The airflow passage may extend through the cartridge and the device portion or may extend through only the cartridge portion.

The electrical contacts may be in the cartridge and may engage with corresponding electrical contacts on the device portion.

The configurations provided herein provide a number of advantages. In particular the present configurations can reduces liquid leakage from an aerosol-generating system or from a cartridge in an aerosol-generating system. The provision of a chamber provides a location within which aerosol-generating substrate in a condensed form, for example which may leak through the liquid-permeable heating element, may collect. The provision of a gas-permeable element inhibits transport of the collected aerosol-generating substrate in a condensed form into the airflow passage. The presently disclosed subject matter also provides a system that is robust and simple to manufacture.

Embodiments of the invention will now be described, by way of example only, with reference to the accompanying drawings, in which.

Figure 1:
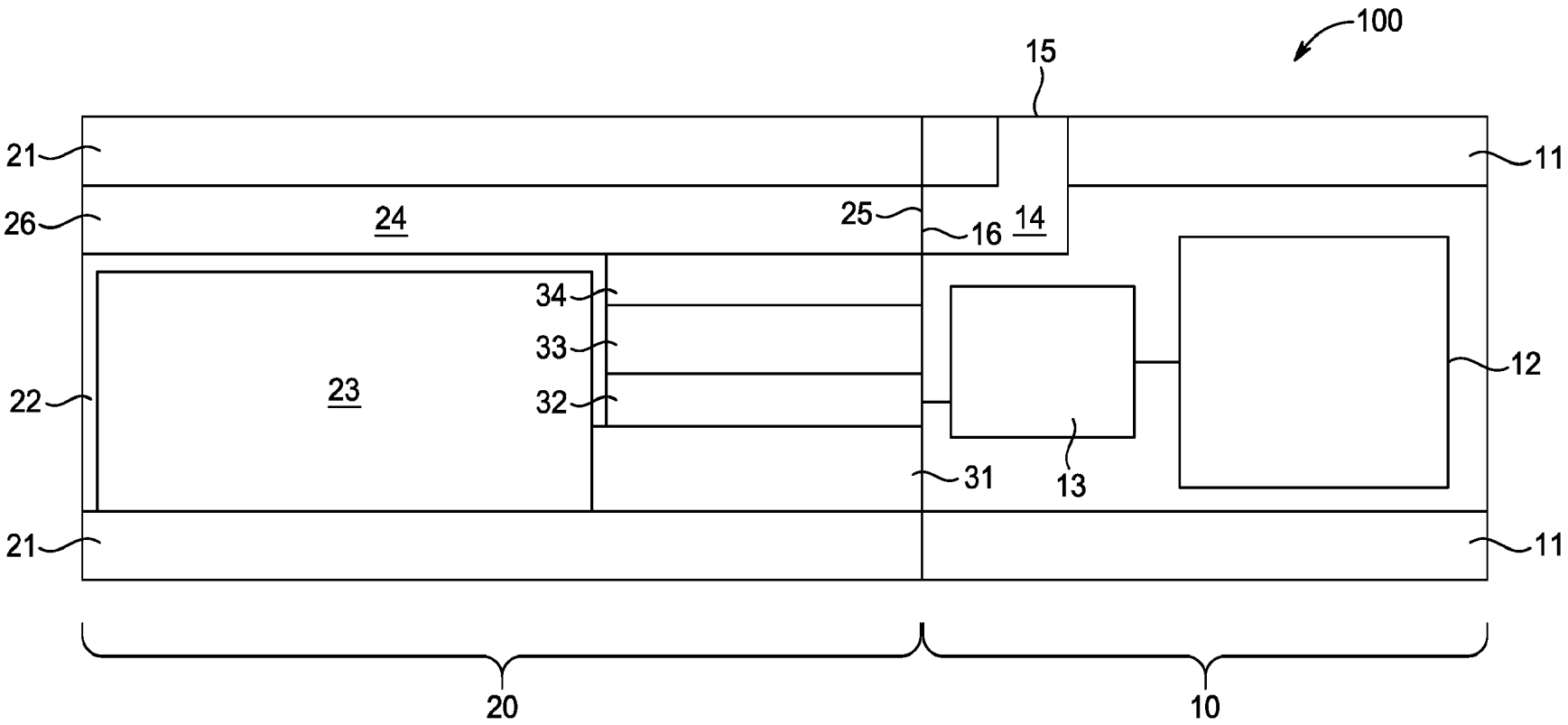
FIG. 1 is a schematic illustration of an aerosol-generating system in accordance with the invention.

FIG. 1 is a schematic illustration of an aerosol-generating system 100 in accordance with the invention. The aerosol-generating system is a handheld smoking system configured to generate aerosol for user inhalation. In particular, the system shown in FIG. 1 is a smoking system that generates an aerosol containing nicotine and flavour compounds.

The system 100 of FIG. 1 comprises two parts, a device portion 10 and a cartridge 20. In use the cartridge 20 is attached to the device portion 10.

The device portion 10 comprises a device housing 11 that holds a rechargeable battery 12 and electrical control circuitry 13. The rechargeable battery 12 is a lithium iron phosphate battery. The control circuitry 13 comprises a programmable microprocessor and an airflow sensor. Optionally, device portion 10 includes device portion air inlet 15, device portion air outlet 16, and device portion airflow passageway 14 extending therebetween.

The cartridge 20 (and thus system 100) can include reservoir 23 holding an aerosol-generating substrate in condensed form; housing 21 comprising air inlet 25, air outlet 26, airflow passage 24 extending therebetween, and chamber 33; liquid-permeable heating element 32 (or other aerosol-generating element) extending generally parallel to airflow passage 24; and gas permeable element 34 extending generally parallel to airflow passage 24. In the configuration illustrated in FIG. 1, one side of the heating element 32 is in fluidic communication, e.g., in direct or indirect contact, with reservoir 23 and an opposite side of the heating element 32 is in fluidic communication, e.g., in direct or indirect contact, with the chamber 33. For example, heating element 32 can be in direct contact with reservoir 23 or can be in indirect contact with reservoir 23 via a channel or transport medium 31. The heating element 32 can be configured to heat the aerosol-generating substrate in condensed form to generate a vapour within the chamber 33 in a manner such as described elsewhere herein. One side of gas-permeable element 34 can be in fluidic communication, e.g., in direct or indirect contact, with chamber 33 and an opposite side of the gas-permeable element 34 can be in fluidic communication, e.g., in direct or indirect contact, with the airflow passage 24. The gas-permeable element 34 can be configured to allow transport of the vapour into the airflow passage 24 and can be configured to inhibit transport of the condensed form of the aerosol-generating substrate into the airflow passage 34. The vapour at least partially condenses into an aerosol within the airflow passage 24.

The cartridge 20 comprises a cartridge housing 21 that is releasably attached to the device housing 11, for example by a snap-fit connection. The cartridge housing 21 holds an aerosol-generating element, which in one configuration is or includes heating element 32. The heating element 32 may, for example, be or include a resistive heating element. Power may be provided to the heating element from the battery 12, under the control of the control circuitry 13. Such power can be conducted from battery 12 to heating element 32 via any suitable combination of conductive materials, such as metal(s)

The cartridge 20 also holds an aerosol-forming substrate in condensed form within reservoir (substrate chamber) 23. In some configurations, reservoir 23 is bounded by sidewall 22 and cartridge housing 21 and fluidically coupled to heater 32 via a channel or one or more transport media, In this example, the aerosol-forming substrate is a liquid mixture at room temperature and comprises nicotine, flavours, an aerosol-former, such a glycerol or propylene glycol, and water. However, it should be understood that any other condensed form of aerosol-forming substrate suitably can be used. In some configurations, one or more transport media, such as one or more capillary materials 31, can be provided in the substrate chamber 23 and can be arranged to promote delivery of the aerosol-forming substrate to the heating element 32, regardless of the orientation of the system 100 relative to gravity.

An entire airflow passage comprising airflow passages 14, 24 is defined through the system. In this example, a portion 24 of the airflow passage is through the cartridge 20 and a portion 14 of the airflow passage is through the device portion 10. The airflow sensor included in the control circuitry 13 is positioned to detect airflow through the portion 14 of the airflow passage in the device portion. The airflow passage of system 100 extends from an air inlet 15 to an air outlet 26. Within device portion 10, the device portion airflow passage 14 extends from device portion air inlet 15 to device portion air outlet 16. Within cartridge 20, airflow passage 24 extends from air inlet 25 to air outlet 26. The air outlet 26 is in a mouthpiece end of the cartridge 20. When the user puffs on the mouthpiece end of the cartridge 20, within cartridge 20 air is drawn from the air inlet 25, through the airflow passage 24, to the air outlet 26.

In the configuration illustrated in FIG. 1, heater 32 is generally planar and is positioned between channel or one or more capillary materials 31 and chamber 33; and gas-permeable element 34 is generally planar, positioned between chamber 33 and airflow passage 24. Heater 32 and gas-permeable element 34 can be arranged substantially parallel to one another and/or can be spaced apart from one another by chamber 33. In operation, heating element 32 vapourises, by heating, the aerosol-forming substrate to form a vapour. The vapour can pass through the mesh heating element 32 into the chamber 33. The gas-permeable element 34 permits transport of the vapour into airflow passage 24. The vapour is entrained in the air flowing through the airflow passage 24 and cools to form an aerosol before exiting the system through the air outlet 26.

Gas permeable element 34 can comprise a mesh. The gas permeable element 34 (e.g., mesh) inhibits liquid droplets having a diameter greater than a particular diameter from leaving chamber 33 and thus inhibits such liquid droplets from entering airflow passage 24. Accordingly, gas permeable element 34 can inhibit transport of the condensed form of the aerosol-generating substrate into airflow passage 24, thus improving user experience.

The system 100, consisting in this example of a device portion 10 and a cartridge 20, is elongate, having a length significantly greater than its width or its thickness. The mouthpiece end is at one end of the length of the system 100, e.g., can be located at the end comprising air outlet 26. This shape allows the system 100 to be comfortably held by a user in a single hand when using the system. The length of the system 100 may be said to extend in a longitudinal direction. The airflow passage including elements 14, 24 extends in the longitudinal direction past the gas-permeable element 34. The fluid permeable heating element 32 and the gas permeable element 34 each and independently can be generally planar and extends parallel to the longitudinal direction. The heating element 32 and the gas-permeable element each and independently may also be elongate, with its length extending in the longitudinal direction. This arrangement allows for a heating element and gas-permeable element with a relatively large surface area to be accommodated in a slim, easy to hold system.

In operation, the heating element 32 may be activated, by control circuitry 13, only during user puffs or may be activated continuously following the system 100 being switched on, e.g., via a switch within device portion 10 and operably coupled to control circuitry 13. In the first case, user puffs are detected when the flow sensor (part of control circuitry 13, not specifically illustrated) detects an airflow through the device portion airflow passage 14 above a threshold airflow rate. In response to the output of the flow sensor, the control circuitry 13 supplies power to the heating element 32. The supply of power to the heating element 32 may be provided for a predetermined period of time following detection of a user puff or may be controlled until a switch-off condition is met, based on signals from the flow sensor and/or based on other inputs received from by the control circuitry 13, such as measures of heating element temperature or resistance. In one example, the heating element 32 is supplied with 6 Watts of power for 3 seconds following detection of a user puff. When the heating element 32 is supplied with power it heats up. When it is sufficiently hot, the liquid aerosol-forming substrate in proximity to the heating element 32 is vapourised and enters chamber 33, from which it is transported through gas-permeable element 34.

In the second case, the heating element 32 is supplied with power continuously during operation by control circuitry 13, following activation of the system 100. Activation may be based on a user input to the system, such as pressing a button or otherwise activating a switch in operable communication with control circuitry 13. In one embodiment, the heating element 32 is supplied with 3.3 Watts of power following activation of the device, regardless of user puffs. Again, this may be adjusted based on other inputs to the control circuitry 13, such as measured heating element temperature or resistance. The system may be switched off following a predetermined time after activation or based on a further user input.

As another alternative, a hybrid power supply scheme may be used in which a lower power, such as 3.3 Watts is supplied between user puffs but a higher power, such as 7

Watts, is supplied for 2 seconds following detection of each user puff. This may result in a greater volume of aerosol being generated.

The vapour generated passes through heating element 32 into chamber, from which it is transported through gas-permeable element 34 and then entrained in the airflow through the airflow passage 24. The vapour cools within the airflow to form an aerosol. The aerosol passes through the air outlet 26 and into the user's mouth.

In configurations including capillary material or other transport media 31, the condensed form of the aerosol-generating substrate (e.g., liquid or gel) that is vapourised by the heating element 32 leaves the capillary material 31. This condensed form (e.g., liquid or gel) is replaced by condensed form (e.g., liquid or gel) still remaining in the substrate chamber 23, so that there is condensed form (e.g., liquid or gel) proximate to the heating element ready for the next user puff.

It is possible that not all of the vapoured aerosol-forming substrate is drawn out of the system 100 by the user puffs. In that case, the aerosol-forming substrate may condense to form large droplets within chamber 33. It may also be possible for some liquid to pass through the heating element 32 without being vapourised, either during use or between uses of the system. Because gas-permeable element 34 inhibits transport of the condensed form of the aerosol-generating substrate into airflow passage 24, large droplets or larger amounts of the condensed form of the aerosol-generating substrate may not be drawn into the user's mouth via airflow passage 24 and air outlet 26, thus improving user experience. For example, large droplets may provide an unpleasant experience for the user if they reach the user's mouth. The gas permeable element 34 thus protects both the user and the control circuitry 13 and battery 12 within the device portion 10 from liquid leakage from the cartridge 20. The gas-permeable element 34 may comprise one layer of mesh, or may comprise more than one layer of mesh. The layers may have different sizes.

Figure 2:
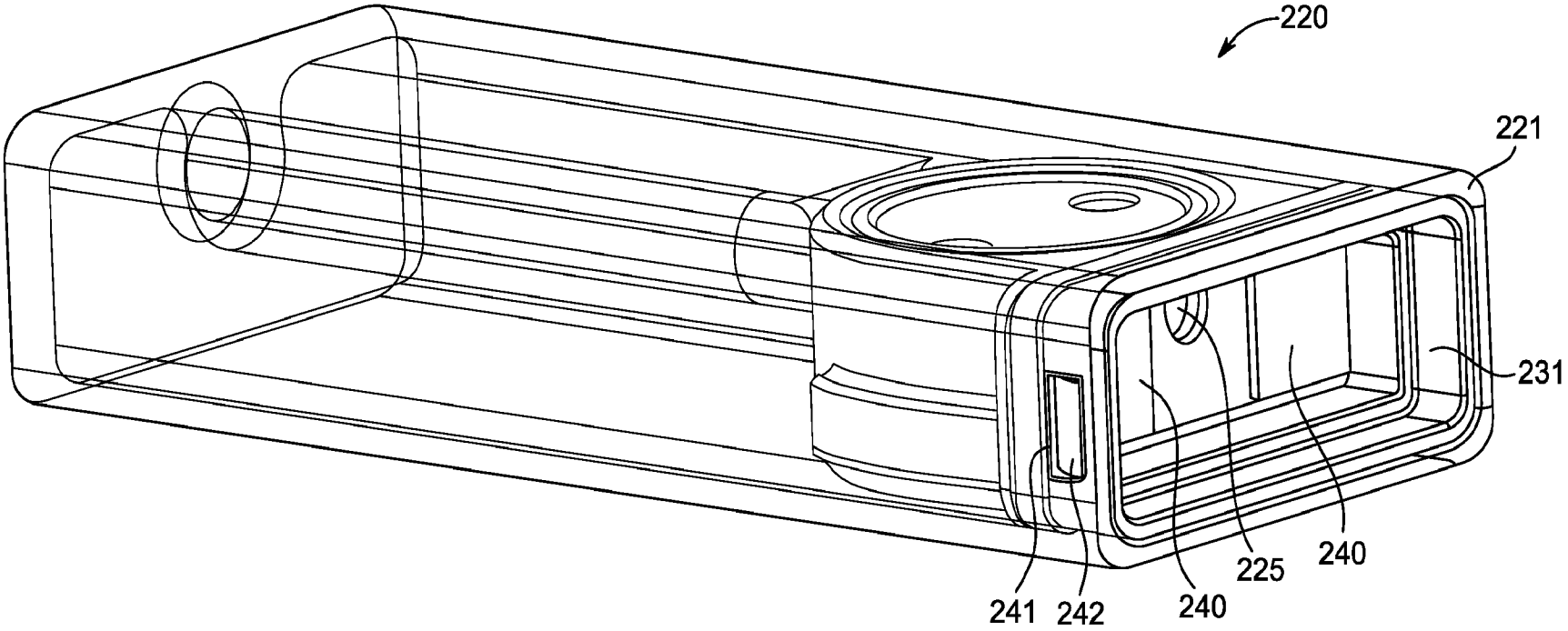
FIG. 2 is a perspective view of a cartridge in accordance with an embodiment of the invention, with certain elements shown in partial transparency.
Figure 3:
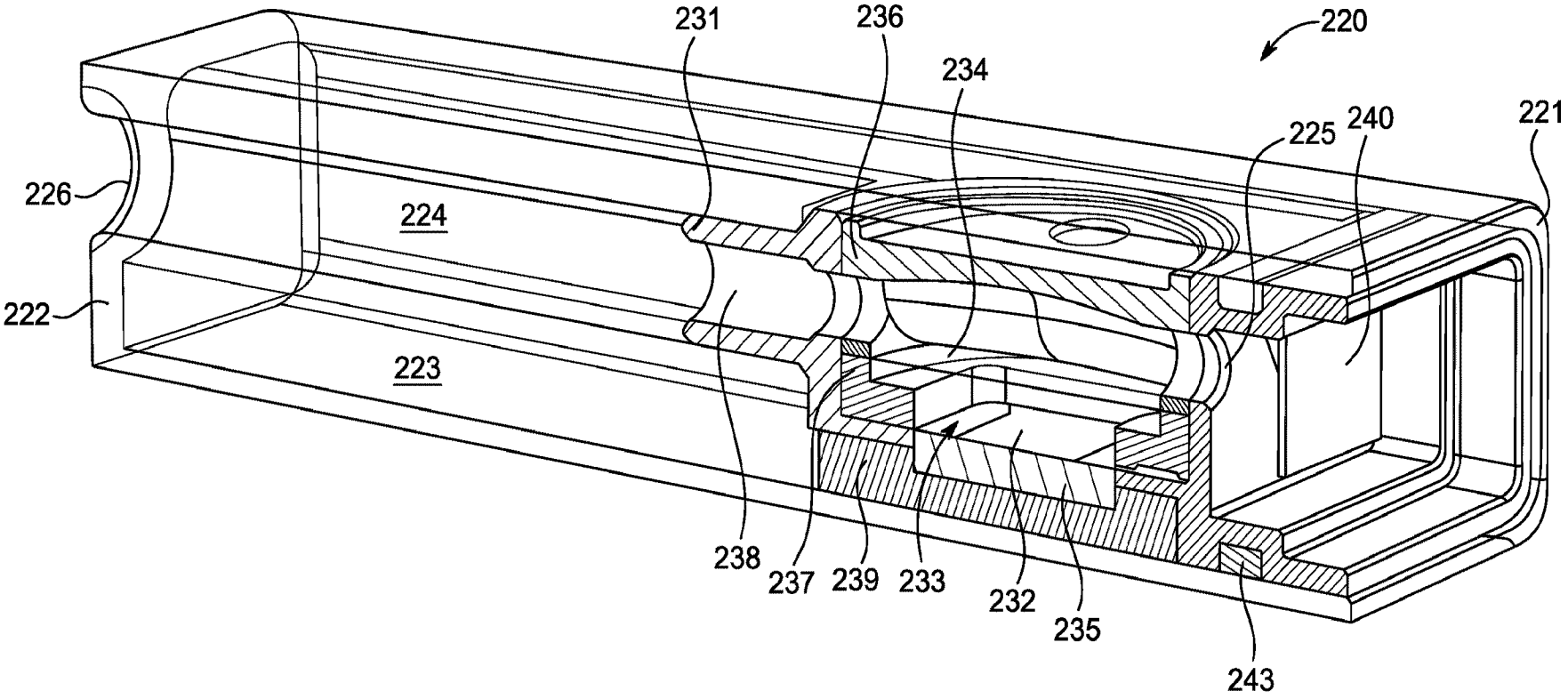
FIG. 3 is cross-section through the cartridge of FIG. 2.
Figure 4:
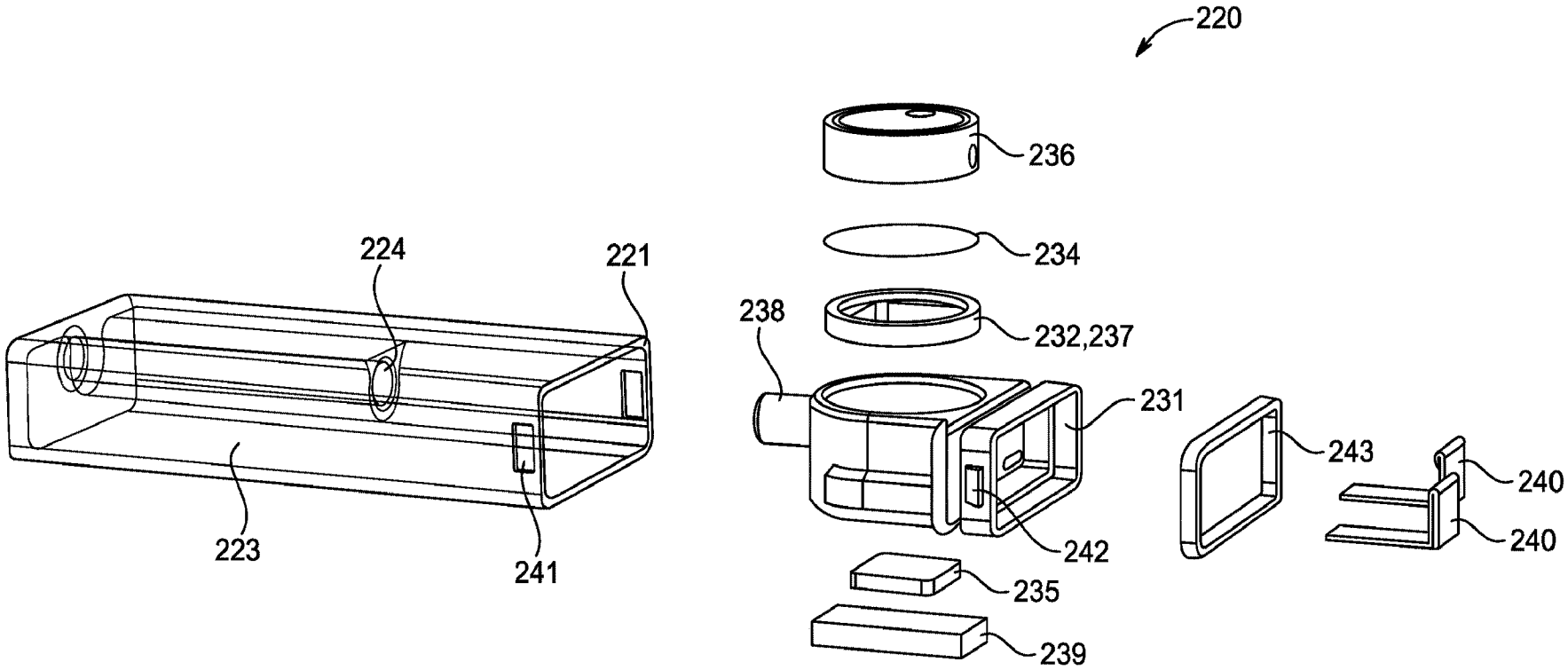
FIG. 4 is an exploded view of the cartridge of FIG. 2.

FIG. 2 is a perspective view of a cartridge 220 in accordance with an embodiment of the invention, with certain elements shown in partial transparency. FIG. 3 is cross-section through the cartridge 220 of FIG. 2. FIG. 4 is an exploded view of the cartridge 220 of FIG. 2.

The cartridge 220 illustrated in FIGS. 2-4 comprises an external housing 221 and internal housing 231. External housing 221 includes airflow passage 224, air outlet 226, reservoir 223, and slots 241. Internal housing 231 includes tabs 242 configured to securably engage with slots 241 so as to lock internal housing 231 within external housing 221 and inhibit access to or leakage of reservoir 223 during normal use. Internal housing 231 includes protrusion 238 which extends into and engages with airflow passage 224 of external housing 221, e.g., in a snug slip-fit engagement or other suitable engagement that inhibits leakage of aerosol-generating substrate in condensed form from reservoir 223 into airflow passage 224.

The internal housing 231 holds first and second capillary materials (two or more transport media) 239, 235, heater assembly including elements 232, 237, gas-permeable element 234, and lid 236. The heater assembly comprises a heater mount 237 which supports liquid-permeable heating element 232. Internal housing 231 holds capillary materials 239, 235 within the heater mount 237 and in fluidic communication, e.g., in direct or indirect contact, with the heating element 232. The cartridge 220 also comprises electrical contact elements 240 that extend between the mesh heating element and an external surface of the cartridge, at the device portion end of the cartridge (opposite the mouthpiece end). The electrical contact elements 240 interface with corresponding electrical contacts on a device portion of the system (e.g., configured analogously to device portion 10 described above with reference to FIG. 1) to allow for the supply of power to the heating element 232 by a battery (e.g., battery 12) under the control of control circuitry (e.g., control circuitry 13). Gas-permeable element 234 is clamped to the heater assembly within the internal housing 231 by lid 236 which fits within and engages with an interior surface of internal housing 231, e.g., in a snug slip-fit engagement or other suitable engagement that inhibits leakage of aerosol-generating substrate in condensed form around the outer sidewalls of lid 236. The airflow passage 224 is defined though the internal housing 231 and the external housing 221 between air inlet 225 and air outlet 226. Air inlet 225 can be coupled to the air outlet of a device portion, e.g., in a manner analogous to coupling of air inlet 25 to air outlet 16 of device portion 10 described with reference to FIG. 1. The space between heater 232 and gas-permeable element 234 defines chamber 233. An elastomer sealing element 243 is provided to provide a liquid tight seal between the internal housing 231 and the external housing 221.

In one exemplary configuration, the mesh of the gas-permeable element 234 is made of stainless steel wire having a diameter of about 50 μm. The apertures of the mesh have a diameter of about 100 μm. The mesh can be coated with silicon carbide.

Additionally, or alternatively, the mesh of the heating element 232 also can be formed from stainless steel and has a mesh size of about 400 Mesh US (about 400 filaments per inch). The filaments can have a diameter of around 16 μm. The filaments forming the mesh can define interstices between the filaments. The interstices in this example have a width of around 37 μm, although larger or smaller interstices may be used. Using a mesh of these approximate dimensions allows a meniscus of aerosol-forming substrate to be formed in the interstices, and for the mesh of the heater assembly to draw aerosol-forming substrate by capillary action. The open area of the heating element mesh, i.e. the ratio of the area of interstices to the total area of the mesh is advantageously between 25 and 56%. The total electrical resistance of the heater assembly is around 1 Ohm.

The internal housing 231 and external housing 221 may be formed from metal or robust plastics materials. Similarly the heater mount 237 and/or lid 236 may be formed from a heat resistant plastics material.

The cartridge of FIGS. 2-4 is simple to assemble. The assembly of the internal housing 231, the capillary material(s) 239, 235, the heater assembly including elements 232, 237, the gas-permeable element 234, lid 236, and sealing element 243 may be described as an atomiser assembly. The atomiser assembly is assembled first. The atomiser assembly is then pushed into the external housing 221. A pair of protrusions 242 on the internal housing 231 snap into corresponding apertures or slots 241 on the external housing 221 to secure the internal housing to the external housing. The chamber 223 holding the aerosol-forming substrate can be defined by both the internal and external housings 231, 221. The external housing 221 may contain the liquid (or another condensed phase) aerosol-forming substrate before the atomiser assembly is attached. Alternatively, the aerosol-forming substrate chamber may be filled after the atomiser assembly is attached to the external housing through a filling port (not shown).

The cartridge of FIGS. 2-4 operates in the manner described in relation to FIG. 1.

Figure 6:
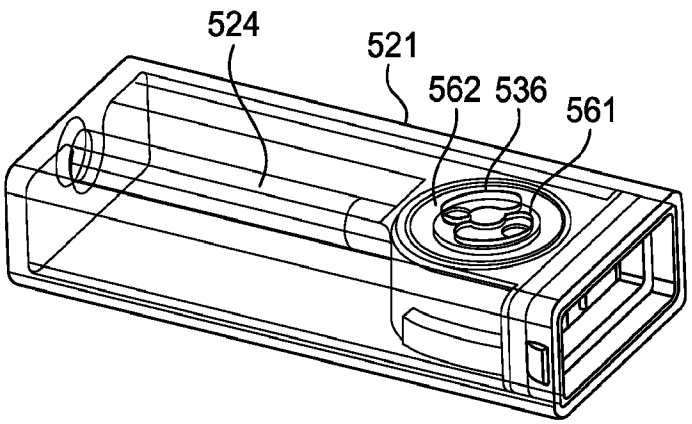
FIG. 6 is a perspective view of the cartridge of FIG. 5, with certain elements shown in partial transparency.
Figure 5:
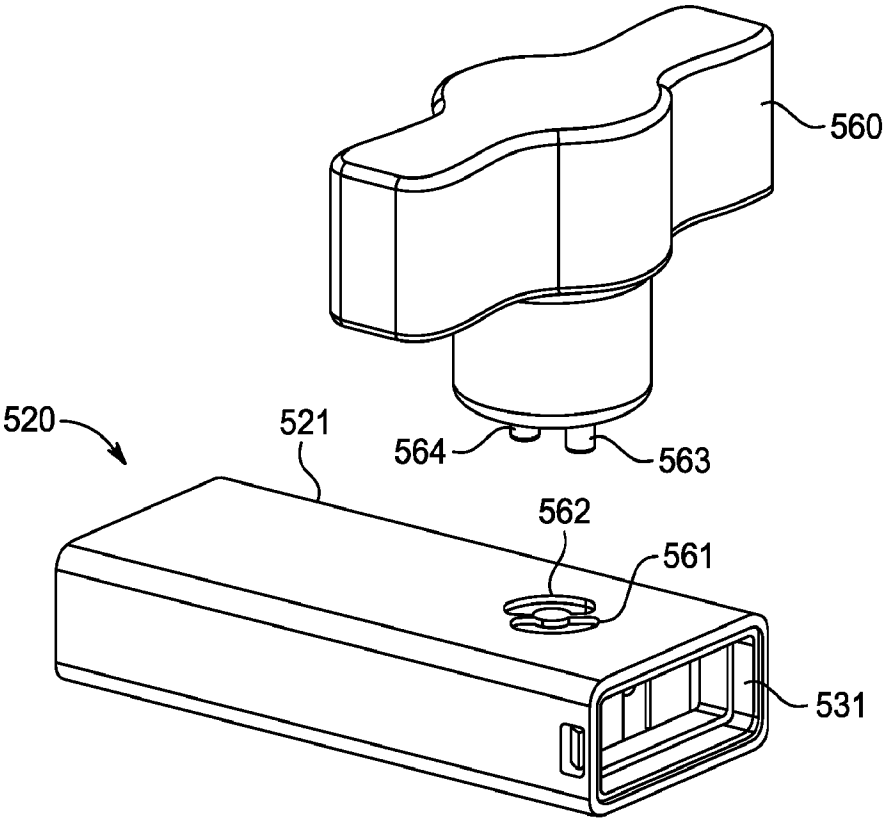
FIG. 5 is a perspective view of a cartridge and key in accordance with another embodiment of the invention.
Figure 7B:
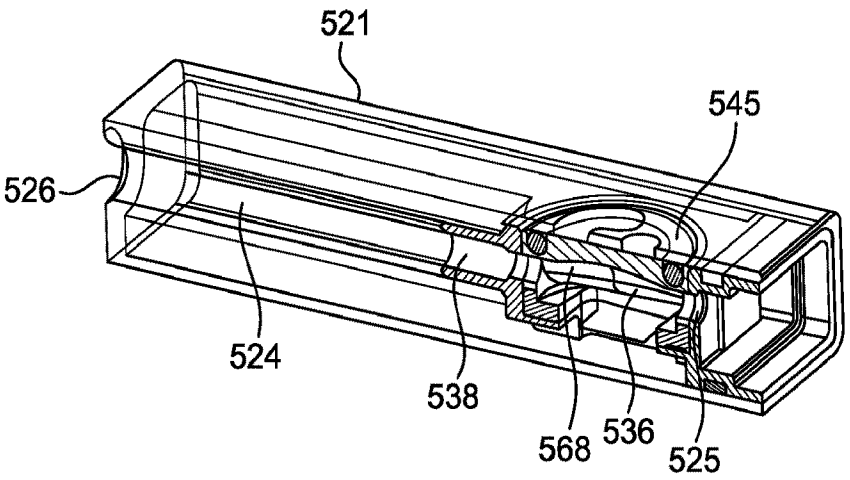
FIG. 7B is cross-section through the cartridge of FIG. 5 in an open position.
Figure 7A:
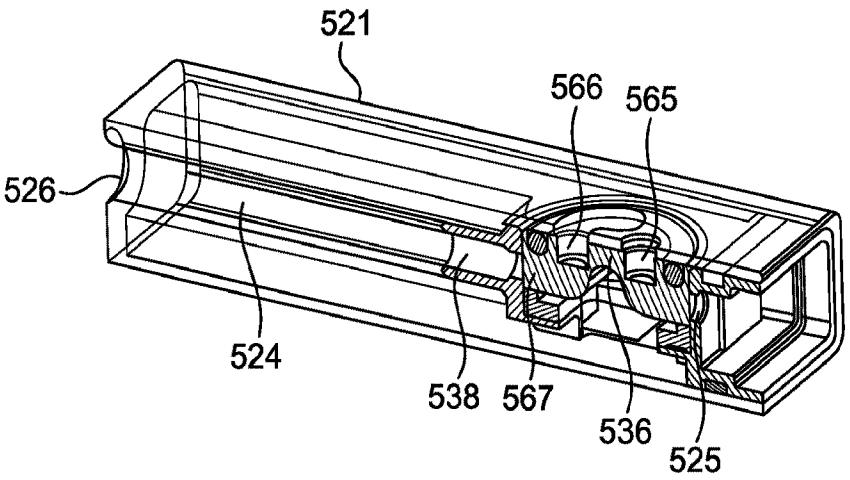
FIG. 7A is cross-section through the cartridge of FIG. 5 in a closed position.
Figure 8:
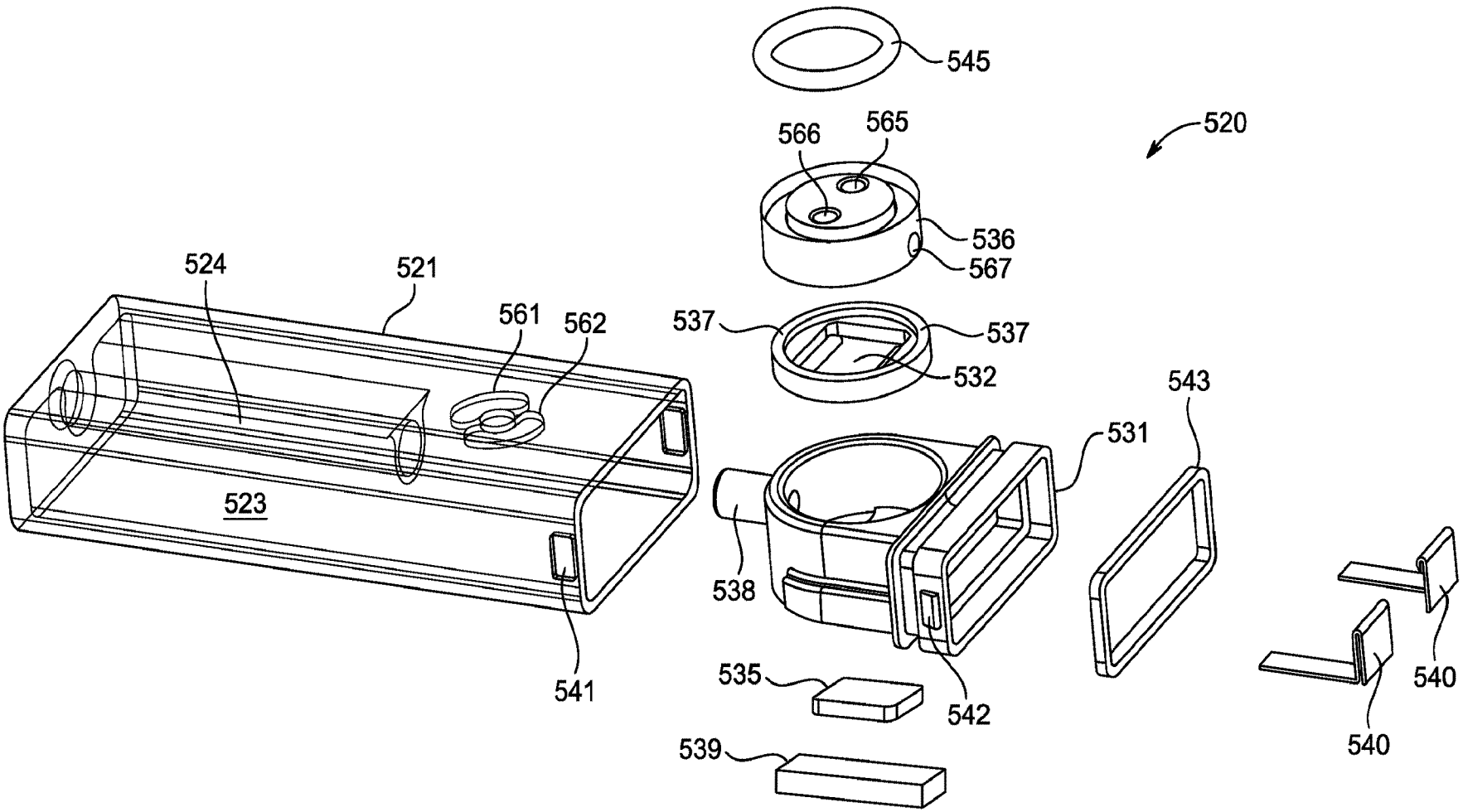
FIG. 8 is an exploded view of the cartridge of FIG. 5.

FIG. 5 is a perspective view of a cartridge 520 and key 560 in accordance with another embodiment of the invention. FIG. 6 is a perspective view of the cartridge of FIG. 5, with certain elements shown in partial transparency. FIG. 7A is cross-section through the cartridge of FIG. 5 in a closed position. FIG. 7B is cross-section through the cartridge of FIG. 5 in an open position. FIG. 8 is an exploded view of the cartridge of FIG. 5.

The cartridge 520 illustrated in FIGS. 5-8 is in many regards analogous to cartridge 220 described with reference to FIGS. 2-4. For example, the cartridge 520 illustrated in FIGS. 5-8 comprises an external housing 521 and internal housing 531. External housing 521 includes airflow passage 524, air outlet 526, reservoir 523, and slots 541. Internal housing 531 includes tabs 542 configured to securably engage with slots 541 so as to lock internal housing 531 within external housing 521 and inhibit access to or leakage of reservoir 523 during normal use. Internal housing 531 includes protrusion 538 which extends into and engages with airflow passage 524 of external housing 521, e.g., in a snug slip-fit engagement or other suitable engagement that inhibits leakage of aerosol-generating substrate in condensed form from reservoir 523 into airflow passage 524.

Analogously as described with reference to FIGS. 2-4, the internal housing 531 of cartridge 520 holds first and second capillary materials (two or more transport media) 539, 535, heater assembly, gas-permeable element 534, and lid 536. The heater assembly comprises a heater mount 537 which supports liquid-permeable heating element 532. Internal housing 531 holds capillary materials 539, 535 within the heater mount 537 and in fluidic communication, e.g., in direct or indirect contact, with the heating element 532 analogously as described elsewhere herein. The cartridge 520 also comprises electrical contact elements 540 that extend between the mesh heating element and an external surface of the cartridge, at the device portion end of the cartridge (opposite the mouthpiece end). The electrical contact elements 540 interface with corresponding electrical contacts on a device portion of the system (e.g., configured analogously to device portion 10 described above with reference to FIG. 1) to allow for the supply of power to the heating element 532 by a battery (e.g., battery 12) under the control of control circuitry (e.g., control circuitry 13). The space between heater 532 and gas-permeable element 534 defines chamber 533. An elastomer sealing element 543 is provided to provide a liquid tight seal between the internal housing 531 and the external housing 521.

Gas-permeable element 534 is clamped to the heater assembly within the internal housing 531 by lid 536 which fits within and engages with an interior surface of internal housing 531, e.g., in a snug slip-fit engagement or other suitable engagement that inhibits leakage of aerosol-generating substrate in condensed form around the outer sidewalls of lid 536. In the configuration shown in FIGS. 5-8, lid 536 is rotatable and thus suitably may fit somewhat less snugly than does lid 236 described with reference to FIGS. 2-4 so as to permit more freedom of movement. Sealing ring 538 can be configured so as to facilitate rotational freedom of movement of lid 536 while maintaining a liquid tight seal to inhibit leakage of aerosol-generating substrate around the sidewalls of lid 536.

Lid 536 illustrated in FIGS. 5-8 is configured so as to open and close, responsive to engagement with and turning of key 560 by a user, the airflow passage 524 though the internal housing 531 and the external housing 521 between air inlet 525 and air outlet 526. More specifically, air inlet 525 can be coupled to the air outlet of a device portion, e.g., in a manner analogous to coupling of air inlet 55 to air outlet 16 of device portion 10 described with reference to FIG. 1. Protrusions 563, 564 on key 560 respectively engage with slots 565, 566 defined within lid 536 via apertures 561, 562 defined within outer housing 521. Responsive to turning of key 560 in a first direction (e.g., clockwise or counter clockwise), a protruding portion 567 of lid 536 can be extended into airflow pathway 524 so as to block the flow of air between air inlet 525 and air outlet 526 in a manner such as shown in FIG. 7A, thus disabling use of the system for a smoking-like experience. Responsive to turning of key 560 in a second direction (e.g., counter clockwise or clockwise), the protruding portion 567 of lid 536 is retracted out of airflow pathway 524 so as to allow the flow of air between air inlet 525 and air outlet 526 through cavity 567 in a manner such as shown in FIG. 7B, thus enabling use of the system for a smoking-like experience. Cavity 568 within the atomizer assembly can be considered to form a first part of the airflow passage between air inlet 525 and air outlet 526, and housing 521 can be considered to form a second part of the airflow passage between air inlet 515 and air outlet 526. Thus, the user can control the enabling or disabling of the system by engaging key 560 with cartridge 520 and rotating the key so as to open or close airflow passage 524, and can remove key 560 so as to secure system in the desired enabled or disabled state.

Optionally, the positions of the ends of apertures 561, 562 can define rotational limits of lid 536, such that a user turning key 560 can only turn lid 536 through a selected range of positions (e.g., between a single closed position such as shown in FIG. 7A and a single open position such as shown in FIG. 7B). In one configuration, apertures 561, 562 are configured such that lid 536 can be turned by about 90 degrees using key 560.

Other components of cartridge 520 can be configured analogously as corresponding components described with reference to FIGS. 2-4, and cartridge 520 can be assembled analogously as described with reference to FIGS. 2-4 with the addition of pressing sealing ring 538 into a recess defined within the top of lid 536. The cartridge of FIGS. 5-8 operates in the manner described in relation to FIG. 1.

Figure 9:
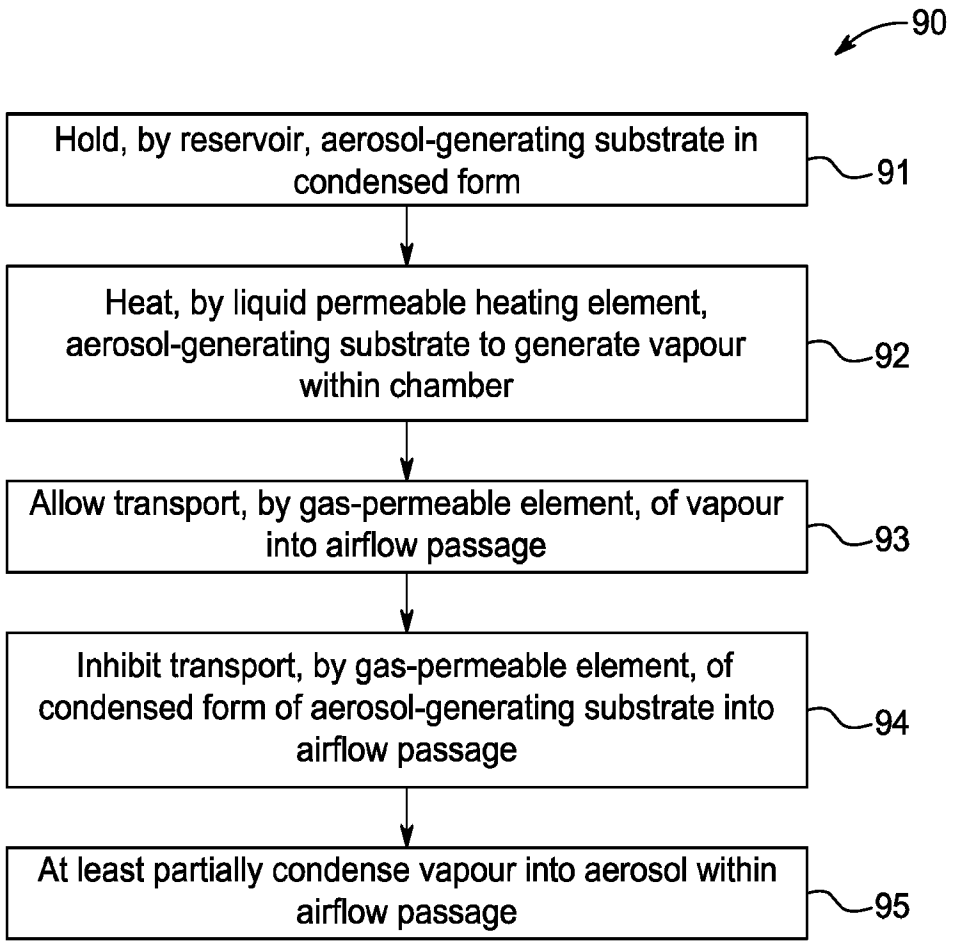
FIG. 9 illustrates a flow of operations in a method for generating an aerosol in accordance with the invention.

FIG. 9 illustrates a flow of operations in a method 90 for generating an aerosol in accordance with the invention. The operations in method 90 may be implemented using system 100 described with reference to FIG. 1, with cartridge 220 described with reference to FIGS. 2-4, and/or with cartridge 520 described with reference to FIGS. 5-8.

Method 90 illustrated in FIG. 9 includes holding, by a reservoir, an aerosol-generating substrate in condensed form (operation 91). For example, reservoir 23 of cartridge 20, reservoir 223 of cartridge 220, or reservoir 523 of cartridge 520 can hold an aerosol-generating substrate in a condensed form. The condensed form can include a solid, a gel, or a liquid. In one nonlimiting example, the aerosol-generating substrate is or includes a liquid.

Method 90 illustrated in FIG. 9 also includes heating, by a liquid permeable heating element, the aerosol-generating substrate to generate a vapour within a chamber (operation 92). For example, heater 32 of cartridge 20 can heat the aerosol-generating substrate received from reservoir 23, thus generating a vapour within chamber 33. As another example, heater 232 of cartridge 220 can heat the aerosol-generating substrate received from reservoir 223, thus generating a vapour within chamber 233. As another example, heater 532 of cartridge 520 can heat the aerosol-generating substrate received from reservoir 523, thus generating a vapour within chamber 533. It should be noted, however, that operation 92 suitably may be modified so as to generate the vapour within the chamber using an operation other than heating, e.g., such as described elsewhere herein.

Method 90 illustrated in FIG. 9 also includes allowing transport, by a gas-permeable element, vapour into an airflow passage (operation 93). For example, gas-permeable element 34 can allow transport of vapour from chamber 33 into airflow passage 24. As another example, gas-permeable element 234 can allow transport of vapour from chamber 233 into airflow passage 224. As yet another example, gas-permeable element 534 can allow transport of vapour from chamber 533 into airflow passage 524.

Method 90 illustrated in FIG. 9 also includes inhibiting transport, by the gas-permeable element, the condensed form of the aerosol-generating substrate into the airflow passage (operation 94). For example, gas-permeable element 34 can inhibit transport of droplets or larger amounts of the aerosol-generating substrate from chamber 33 into airflow passage 24. As another example, gas-permeable element 234 can inhibit transport of droplets or larger amounts of the aerosol-generating substrate from chamber 233 into airflow passage 224. As yet another example, gas-permeable element 534 can inhibit transport of droplets or larger amounts of the aerosol-generating substrate from chamber 533 into airflow passage 524.

Method 90 illustrated in FIG. 9 also includes at least partially condensing vapour into an aerosol within the airflow passage (operation 95). For example, the vapour for which the gas permeable element 34 permits transport into airflow passage 24 can condense into an aerosol after being transported into such passage. Or, for example, the vapour for which the gas permeable element 234 permits transport into airflow passage 224 can condense into an aerosol after being transported into such passage. Or, for example, the vapour for which the gas permeable element 534 permits transport into airflow passage 524 can condense into an aerosol after being transported into such passage.

Optionally, the heating element (e.g., 32, 232, or 532) or other aerosol-generating element used in operation 92 can extend generally parallel to an airflow passage (e.g., 24, 224, 524) within a housing (e.g., 21, 221, 521). Optionally, the housing (e.g., 21, 221, 521) can further comprise an air inlet (e.g., 25, 225, 525) and an air outlet (e.g., 26, 226, 526), the airflow passage extending therebetween. Optionally, the chamber (e.g., 33, 233, 533) can be disposed within the housing (21, 221, 521). Optionally, one side of the heating element (e.g., 32, 232, or 532) can be in fluidic communication, e.g., in direct or indirect contact, with the reservoir (e.g., 23, 223, 523) and an opposite side of the heating element can be in fluidic communication, e.g., in direct or indirect contact, with the chamber (e.g., 33, 233, 533).

Additionally, or alternatively, the gas-permeable element used in operations 93 and 94 (e.g., 34, 234, 534) optionally extends parallel to the airflow passage (e.g., 24, 224, 524). Optionally, one side of the gas-permeable element (e.g., 34, 234, 534) can be in fluidic communication, e.g., in direct or indirect contact, with the chamber (e.g., 33, 233, 533) and an opposite side of the gas-permeable element can be in fluidic communication, e.g., in direct or indirect contact, with the airflow passage (e.g., 24, 224, 524).

Exemplary configurations including such options are provided with reference to FIG. 1, FIGS. 2-4, and FIGS. 5-8.

Optionally, the gas-permeable element (e.g., 34, 234, 534) comprises a mesh. The mesh optionally is hydrophobic. Additionally, or alternatively, optionally the mesh is formed from wire having a diameter between about 10 μm and 100 μm. Additionally, or alternatively, optionally the aerosol-generating substrate comprises nicotine. Additionally, or alternatively, the housing (e.g., 21, 221, 521) comprises a mouthpiece (distal end of 21, 221, 521) in which the reservoir (e.g., 23, 223, 523) is disposed. Additionally, or alternatively, the system further comprises an atomizer assembly holding the liquid-permeable heating element (e.g., 32, 232, or 532) and the gas-permeable element (e.g., 34, 234, 534) in spaced relation to one another. Optionally, the atomizer assembly further comprises a lid (e.g., 36, 236, or 536) extending generally parallel to the airflow passage, the gas-permeable element (e.g., 34, 234, 534) being disposed between the lid and the heating element. Optionally, the lid comprises a protruding portion (567) configured to block the airflow passage (e.g., 24, 224, 524) responsive to rotation of the lid. Additionally, or alternatively, optionally the lid further comprises a slot (e.g., 561, 562) configured to receive a key (560), the lid being rotatable responsive to engagement of the key into the slot followed by rotation of the key. Additionally, or alternatively, optionally a first portion of the airflow passage is defined in the mouthpiece (e.g., distal end of 21, 221, 521) and a second portion of the airflow passage is defined in the atomizer assembly. Additionally, or alternatively, optionally the airflow passage extends in a straight line between the air inlet (e.g., 25, 225, 525) and the air outlet (e.g., 26, 226, 526). Additionally, or alternatively, optionally the heating element (e.g., 32, 232, 532) is a mesh heating element. Additionally, or alternatively, the system optionally further includes a device portion (e.g., 10) comprising a power supply (e.g., 12) and control circuitry (e.g., 13) connected to the power supply, the device portion being coupled to the housing (e.g., 21, 221, 521) to allow for a supply of power from the power supply to the heating element (e.g., 32, 232, 532).

In the examples described, both the liquid-permeable heater and the gas-permeable element are in the cartridge. However, it should be clear that either or both of such elements, for example, could be positioned within the device portion. It should also be clear that the shape and size of the airflow channel and in particular the atomisation chamber may be altered to provide for particular, desired properties of the aerosol delivered to the user.

It should be clear that, although certain of the examples described use a liquid aerosol-forming substrate, the provision of a gas-permeable element is beneficial in systems that use other forms of aerosol-forming substrate. An aerosol-forming substrate that is a solid or a gel at room temperature, may still release volatile components that condense into a liquid form in the atomising chamber. For example, the aerosol-forming substrate may be provided as a gel tablet. The aerosol-forming substrate may comprise particulate or cut tobacco.

It should also be clear that, although the examples describe the use of a resistive heating element to form an aerosol, the provision of a gas-permeable element is beneficial in systems that operate using different kinds of heating element, such as an inductively heated heating element. The heating element need not be a fluid permeable heating element positioned between the aerosol-forming substrate and the chamber. The heating element may be an oven heater that heats the walls of the aerosol-forming substrate chamber to generate a vapour. The vapour may pass to the airflow passage through the gas-permeable element. The provision of a gas-permeable element further may be beneficial for systems that form an aerosol by means other than heating.

The invention claimed is:

1. An aerosol-generating system, comprising:

a reservoir holding an aerosol-generating substrate in condensed form;

a housing comprising an air inlet, an air outlet, an airflow passage extending therebetween, and a chamber;

a liquid-permeable heating element extending generally parallel to the airflow passage, one side of the liquid-permeable heating element being in fluidic communication with the reservoir and an opposite side of the liquid-permeable heating element being in fluidic communication with the chamber, the liquid-permeable heating element configured to heat the aerosol-generating substrate in condensed form to generate a vapour within the chamber; and a gas-permeable element extending generally parallel to the airflow passage, one side of the gas-permeable element being in fluidic communication with the chamber and an opposite side of the gas-permeable element being in fluidic communication with the airflow passage, wherein the gas-permeable element separates the chamber from the airflow passage and is configured to allow transport of the vapour into the airflow passage and to inhibit transport of the condensed form of the aerosol-generating substrate into the airflow passage, and wherein the vapour at least partially condenses into an aerosol within the airflow passage.

2. The aerosol-generating system according to claim 1, wherein the gas-permeable element comprises a mesh.

3. The aerosol-generating system according to claim 2, wherein the mesh is hydrophobic.

4. The aerosol-generating system according to claim 2, wherein the mesh is formed from wire having a diameter between about 10 μm and 100 μm.

5. The aerosol-generating system according to claim 1, wherein the aerosol-generating substrate comprises nicotine.

6. The aerosol-generating system according to claim 1, wherein the housing further comprises a mouthpiece in which the reservoir is disposed.

7. The aerosol-generating system according to claim 1, further comprising an atomizer assembly holding the liquid-permeable heating element and the gas-permeable element in spaced relation to one another.

8. The aerosol-generating system according to claim 7, wherein the atomizer assembly further comprises a lid, the gas-permeable element being disposed between the lid and the liquid-permeable heating element.

9. The aerosol-generating system according to claim 8, wherein the lid is rotatable between an open position in which a cavity in the lid aligns with the airflow passage and a closed position in which a protruding portion of the lid isolates the cavity from the airflow passage.

10. The aerosol-generating system according to claim 8, wherein the lid further comprises a slot configured to receive a key, the lid being rotatable responsive to engagement of the key into the slot followed by rotation of the key.

11. The aerosol-generating system according to claim 6, further comprising an atomizer assembly holding the liquid-permeable heating element and the gas-permeable element in spaced relation to one another, wherein a first portion of the airflow passage is defined in the mouthpiece and a second portion of the airflow passage is defined in the atomizer assembly.

12. The aerosol-generating system according to claim 1, wherein the airflow passage extends in a straight line between the air inlet and the air outlet.

13. The aerosol-generating system according to claim 1, wherein the liquid-permeable heating element is a mesh heating element.

14. The aerosol-generating system according to claim 1, further comprising a device portion comprising a power supply and control circuitry connected to the power supply, the device portion being coupled to the housing to allow for a supply of power from the power supply to the liquid-permeable heating element.

15. A method for generating an aerosol, the method comprising:

providing an aerosol-generating system according to claim 1;

holding, by the reservoir, the aerosol-generating substrate in condensed form;

heating, by the liquid-permeable heating element, the aerosol-generating substrate to generate the vapour within the chamber;

allowing transport, by the gas-permeable element, of the vapour into the airflow passage;

inhibiting transport, by the gas-permeable element, of the condensed form of the aerosol-generating substrate into the airflow passage; and at least partially condensing the vapour into the aerosol within the airflow passage.

* * * * *